US010810846B1

(12) United States Patent
Gonzalez

(10) Patent No.: US 10,810,846 B1
(45) Date of Patent: Oct. 20, 2020

(54) FIREARM SECURITY SYSTEM FOR SECURING A FIREARM AND NOTIFYING AN OWNER OF UNAUTHORIZED ACCESS OF THE FIREARM

(71) Applicant: Robert Gonzalez, Schertz, TX (US)

(72) Inventor: Robert Gonzalez, Schertz, TX (US)

( * ) Notice: Subject to any disclaimer, the term of this patent is extended or adjusted under 35 U.S.C. 154(b) by 0 days.

(21) Appl. No.: 16/506,561

(22) Filed: Jul. 9, 2019

(51) Int. Cl.
*G08B 13/14* (2006.01)
*A47B 81/00* (2006.01)
*G08B 1/08* (2006.01)

(52) U.S. Cl.
CPC ..... *G08B 13/149* (2013.01); *A47B 81/005* (2013.01); *G08B 1/08* (2013.01)

(58) Field of Classification Search
CPC ..... F41A 23/18; F41A 23/00; F41A 23/02; A47B 81/005; G08B 13/149; Y10S 224/912; Y10T 70/5031
USPC ..... 340/568.1
See application file for complete search history.

(56) References Cited

U.S. PATENT DOCUMENTS 9,754,467 B1 * 9/2017 Harrison ..... F41A 23/18
9,928,676 B2 3/2018 Rambadt et al.
10,107,579 B2 10/2018 Winiecki et al.
2002/0032976 A1 * 3/2002 Riener ..... F41A 17/063 42/70.11
2004/0066275 A1 * 4/2004 Mickler ..... F41C 33/06 340/5.33
2008/0252414 A1 * 10/2008 Crigger ..... G07C 9/28 340/5.52
2018/0364000 A1 12/2018 Sims

FOREIGN PATENT DOCUMENTS

WO WO -2005013031 A2 * 2/2005 ..... A47B 81/005

* cited by examiner

*Primary Examiner* — Emily C Terrell
(74) *Attorney, Agent, or Firm* — Sanchelima & Associates, P.A.; Christian Sanchelima; Jesus Sanchelima

(57) ABSTRACT

A firearm security system for securing a firearm and alerting an owner of the firearm when an unauthorized user accesses the firearm is disclosed. The firearm security system comprises a rack. The rack comprises a door operated using an authentication mechanism. The rack comprises a magnetic section. The rack comprises a first processor. The firearm is provided with a magnetic strip. The magnetic strip of the firearm is mounted to the magnetic section at the rack. The first processor transmits an alert to an electronic device of the owner when the firearm is removed from the magnetic section without the authentication mechanism, indicating that an unauthorized user removed the firearm from the rack. Thus allowing the rightful owner to be able to locate and retrieve their firearm from the unauthorized user.

8 Claims, 5 Drawing Sheets

FIREARM SECURITY SYSTEM FOR SECURING A FIREARM AND NOTIFYING AN OWNER OF UNAUTHORIZED ACCESS OF THE FIREARM

BACKGROUND OF THE INVENTION

1. Field of the Invention

The present disclosure relates to securing and tracking firearms. More specifically, the present disclosure relates a firearm security system that secures a firearm and notifies an owner of unauthorized use of the firearm and allows the owner to track the firearm.

2. Description of the Related Art

With increase in accidental shootings, mass shootings by certain individuals or use by children has increased the need for gun safety. In recent times, most of crimes have been committed by criminals through use of a firearm that is not their own. Therefore, there is urgent need to keep the firearms safe and also to alert an owner of the firearm and also emergency personnel of unauthorized use of the firearm.

Several solutions have been proposed in the past to safely secure the firearm, that has produced a number of specialty products, including, for example, trigger locks, gun safes, gun drawers, gun cases, gun cables, barrel locks, locking gun racks, finger print identifiers, trigger pins, firearm tracking systems and other devices. One such example is disclosed in a United States patent application 20180364000. In US20180364000A1, a firearm tracking system to locate missing firearms is disclosed. The firearm tracking system includes a firearm, having a body with a chamber designed to hold a plurality of bullets, a barrel designed to fire each bullet, and a trigger in communication with the chamber and barrel. A GPS unit is removably secured within the body of the firearm, and the GPS unit is in constant communication with a mobile electronic device designed to detect the location of the firearm. The trigger is designed to lock when the GPS unit is not secured within the body of the firearm. A power source is additionally disposed within the firearm and designed to provide power to the GPS unit and a solar panel, operably connected to the power source, is located on the firearm. In this way, the firearm tracking system is designed to provide a constant and accurate location of a missing firearm.

Another example is disclosed in a U.S. Pat. No. 10,107,579. In U.S. Ser. No. 10/107,579B2, it is disclosed that a method of monitoring and trigger locking a firearm prevents unauthorized persons from firing the firearm. When a person picks up the firearm, a biometric scanner retrieves an unidentified biometric reading off of the person. The biometric scanner can be a palm-print reader and/or a fingerprint reader. If the unidentified biometric reading does not match an authorized user signature stored on a chipset of the firearm, and if the firearm has unlocked its trigger, then the firearm automatically locks its trigger. In addition, the firearm generates and broadcasts an unauthorized-use notification with a wireless communication module. If the unidentified biometric reading does match an authorized user signature stored on the chipset, and if the firearm has locked its trigger, then firearm automatically unlocks its trigger. The firearm also collects situational data from environmental sensors when the firearm discharges a round.

Another example is disclosed in a U.S. Pat. No. 9,928,676. In U.S. Pat. No. 9,928,676B2, it is disclosed that the firearm storage receptacle for mount on a wall in a public environment with a loaded firearm encased inside is disclosed. When an active shooter or potential life or death situation should arise, an approved/authorized individual can access safely the firearm through biometric data recognition system while simultaneously contacting the local authorities in the area to alert that there is an active shooter in the facility. The firearm storage receptacle would also include a florescent colored spray applied to the personnel when opening the firearm storage receptacle to identify who is the protector and who is the assailant, thus eliminating the risk of an accidental shooting of the protector.

Another example is disclosed in a United States patent application 20180058786. In US20180058786A1, a firearm safety system and method is described. The system may include a tracking system, a smart firearm and/or a smart magazine, and a smart tracking unit. The tracking system is in communication with satellites that monitor specific locations, a smart firearm and a portable electronic device. The tracking system includes an internal geographical database of specific monitored locations. The smart firearm includes a microprocessor and a receiver. The motor operates in response to a signal received, which may indicate that the firearm is approaching a no gun safety zone, whereby the signal causes the microprocessor to operate the automatic safety lock to prevent the apparatus from operating. The receiver monitors signals and receives location data from the satellites. The method of operating a smart firearm includes receiving a signal at the at least one receiver and responding to the signal by locking the automatic safety lock.

Although the firearm safety systems discussed above are capable of securing and/or tracking of the firearms, they are inconvenient to use and overly complex as the safety and/or tracking systems are embedded in the firearm. As a result, the safety and/or tracking systems are to be included at the time of manufacturing and it will be expensive to fit them in existing firearms.

Other documents describing the closest subject matter provide for a number of more or less complicated features that fail to solve the problem in an efficient and economical way. None of these patents suggest the novel features of the present invention. Specifically, none of the disclosures in the art disclose a firearm security system that can be retrofitted to an existing firearm. Further, none of the disclosures in the art disclose a firearm security system that notifies an owner of unauthorized use of a firearm and allows the owner to track the firearm.

Therefore, there is a need in the art for a firearm security system that notifies an owner of unauthorized use of a firearm and allows the owner to track the firearm.

SUMMARY OF THE INVENTION

It is one of the objects of the present invention to provide a firearm security system for securing a firearm and alerting an owner of the firearm when an unauthorized user accesses the firearm and avoids the drawbacks of the prior art.

It is another object of the present invention to provide a firearm security system that notifies an owner of unauthorized use of a firearm and allows the owner to track the firearm.

It is one object of the present invention to provide a firearm security system for securing a firearm and alerting an owner of the firearm when an unauthorized user accesses the firearm. The firearm security system comprises a rack. The rack comprises a door operated using an authentication mechanism. The rack comprises a magnetic section. The rack comprises a first processor. The firearm is provided with a magnetic strip. The magnetic strip is used to mount the firearm to the magnetic section at the rack. The first processor transmits an alert to an electronic device of the owner when the firearm is removed from the magnetic section without the authentication mechanism, indicating that an unauthorized user removed the firearm from the rack.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a firearm security system for securing a firearm and alerting an owner of the firearm when an unauthorized user accesses the firearm. The firearm security system comprises a rack. The rack comprises a door operated using an authentication mechanism. The rack comprises a magnetic section. The rack comprises a first processor. The firearm is provided with a magnetic strip. The magnetic strip of the firearm is mounted to the magnetic section at the rack. The first processor transmits an alert to an electronic device of the owner when the firearm is removed from the magnetic section without the authentication mechanism, indicating that an unauthorized user removed the firearm from the rack.

Various features and embodiments of a firearm security system for securing a firearm and alerting an owner of the firearm when an unauthorized user accesses the firearm are explained in conjunction with the description of FIGS. 1-6.

Figure 1:
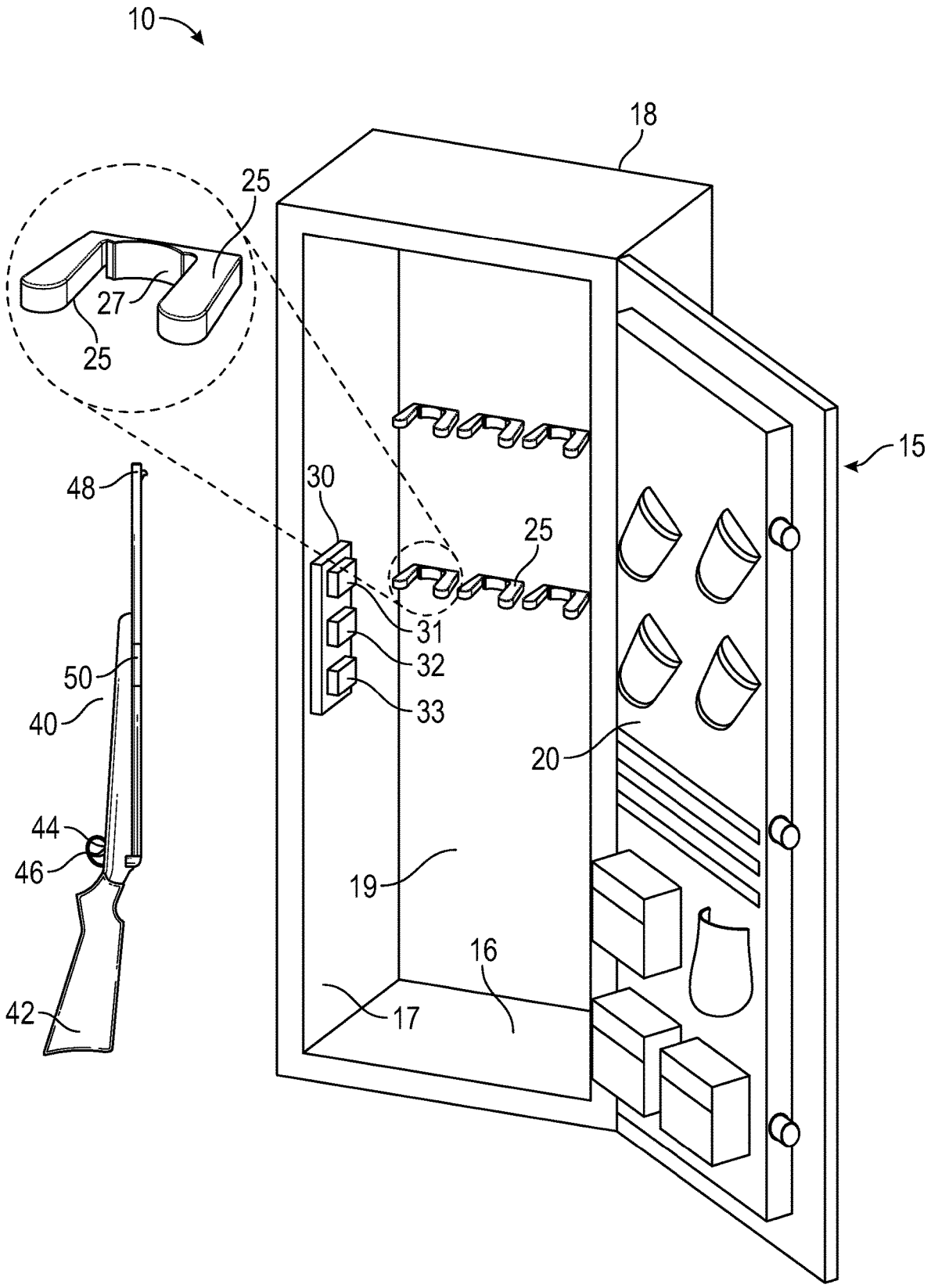
FIG. 1 illustrates a schematic diagram of a firearm security system 10 comprising a rack 15 and a firearm 40 comprising a magnetic strip 50, in accordance with one embodiment of the present disclosure.

Referring to FIG. 1, a schematic diagram of a firearm security system 10 is shown, in accordance with one embodiment of the present disclosure. The firearm security system 10 comprises a rack 15. The rack 15 may indicate a housing made up of metal, hard plastic or any other suitable material. The rack 15 might be provided in a box-like structure or a container in variety of shapes such as square, rectangular or any other shape. The rack 15 may include a gun safe or gun rack that is used to store or affix a firearm.

Figure 2:
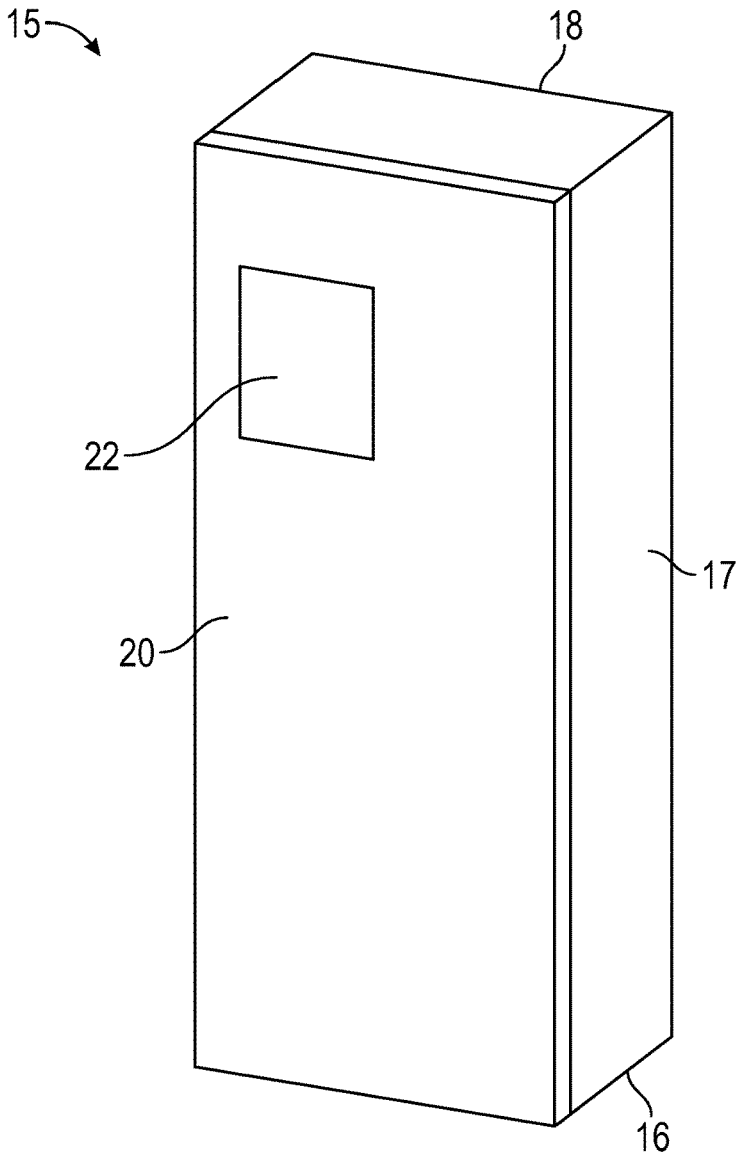
FIG. 2 illustrates the rack 15, in accordance with one embodiment of the present disclosure.

The rack 15 comprises a bottom 16, sidewalls 17, a top 18 and a rear wall 19 and a door 20. Referring to FIG. 2, the rack 15 in closed position in which the door 20 is closed to form a closed structure. At outer side of the door 20, the rack 15 comprises a display 22. The display 22 might include a touch screen display that can be used as an input device to control operation of the rack 15. Thereby meaning display 22 allows control and operation of rack 15 locally. The display 22 might include a resistive or capacitive touch screen panel that is sensitive to pressure and is used to interact with the rack 15. The display 22 is configured with a software interface to control operation of the rack 15. Alternatively, the display 22 might include toggles physical or software interface or combination thereof for controlling operation of the rack 15. The display 22 might allow a user or owner to interact with the rack 15 using a stylus or finger. The user or owner may interact with display 22 in order to disable any alarm or alert being generated by rack 15 having an unauthorized person access items held within rack 15 as to allow a user to locally control rack 15 and its operations.

The rack 15 comprises a plurality of magnetic sections 25. The plurality of magnetic sections 25 might be provided at the rear wall 19 of the rack 15. Alternatively, the plurality of magnetic sections 25 might be provided at the sidewalls 17. Each of the plurality of magnetic sections 25 might be provided in a U-shaped structure. However, it should be understood that the magnetic sections 25 might be provided in another shapes. Each of the magnetic sections 25 indicates a magnetic member capable of attracting metals. Further, the magnetic section 25 might comprises a pressure sensor 27. The pressure sensor 27 is configured to detect presence or mounting of other objects to the magnetic section 25

The rack 15 is provided with a housing 30. The housing 30 might be made up metal, plastic or any other material. The housing 30 might be provided in various shapes and sizes. The housing 30 comprises a first processor 31, a first transceiver 32 and a first battery 33. The first processor 31 might be implemented as one or more microprocessors, microcomputers, controllers, digital signal processors, central processing units, state machines, logic circuitries, and/or any devices that manipulate signals based on operational instructions. Among other capabilities, the first processor 31 is configured to fetch and execute computer-readable instructions or program instructions stored in a memory.

The first transceiver 32 is used to transmit and receive signal/data from the rack 15 to external devices. The first transceiver 32 may transmit the data over a short-range wireless communication protocols such as Bluetooth, NFC, Wi-Fi and so on. The first transceiver 32 may also transmit the data over a long-range communication protocol including, but not limited to a cellular network, satellite or any other protocol.

The first battery 33 may include a rechargeable battery, for example a Lithium-Ion battery.

Figure 3:
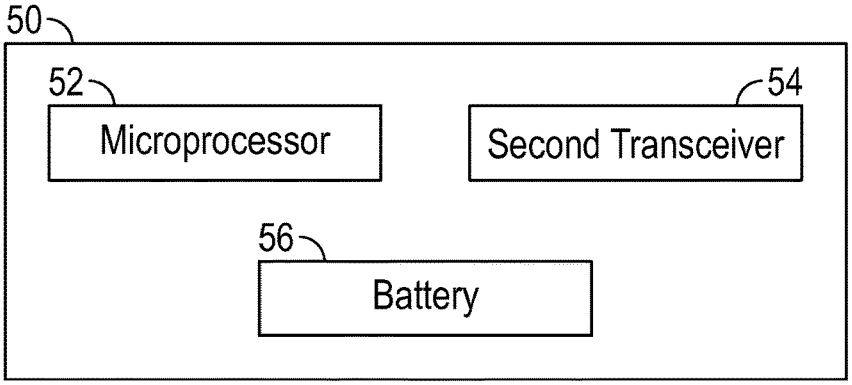
FIG. 3 illustrates a block diagram of the magnetic strip 50.

Further, the firearm security system 10 comprises a firearm 40. As known, the firearm 40 comprises a stock 42, a trigger 44 and a trigger guard 46 provided around the trigger 44. Further, the firearm 40 comprises a barrel 48. In accordance with one embodiment of the present disclosure, the firearm 40 is provided with a magnetic strip 50. It should be understood that the magnetic strip 50 is provided at the barrel 48. In one implementation, the firearm 40 might be constructed such that the firearm 40 can be wirelessly connected to the rack 15. In order to communicatively couple the firearm 40 to the rack 15, the firearm 40 is provided with a microcontroller and a second transceiver. In one example, the microcontroller and the second transceiver are provided in the magnetic strip 50 such that the microcontroller and the second transceiver are concealed to human eye. Referring to FIG. 3, a block diagram of magnetic strip 50 comprising a microcontroller 52, a second transceiver 54, and a battery 56 is shown.

The microcontroller 52 may be implemented digital signal processors, central processing units, logic circuitries, and/or any devices that manipulate signals based on operational instructions. The microcontroller 52 may comprise a small memory capable of executing computer-readable instructions or program instructions stored therein.

The second transceiver 54 is used to transmit and receive signal/data from the magnetic strip 50 of the firearm 40 to external devices. The second transceiver 54 may transmit the data over a short-range wireless communication protocols such as Bluetooth, NFC, Wi-Fi and so on. The second transceiver 54 may also transmit the data over a long-range communication protocol including, but not limited to a cellular network, satellite or any other protocol. In one example, the second transceiver 54 might be used as a location sensor for determining location of the firearm 40. In order to determine the location of the firearm 40, the second transceiver 54 may be used to triangulate the location of the firearm 40 and send a signal indicating coordinates of the firearm 40. In one example, the second transceiver 54 includes a Global Positioning System (GPS) sensor or any other sensor capable of determining the location.

In one example, the battery 56 might be used to power the microcontroller 52 and the second transceiver 54.

Figure 4:
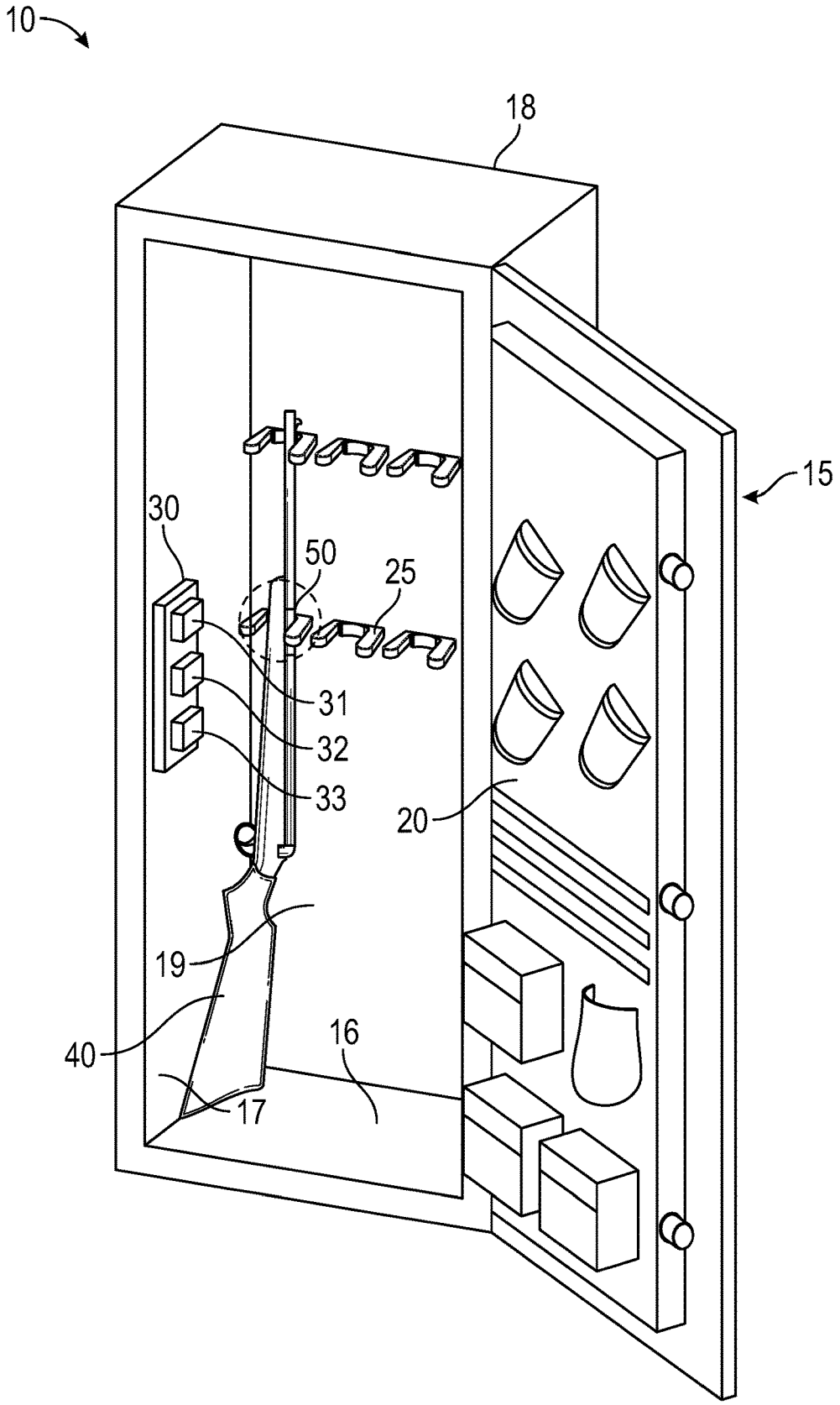
FIG. 4 illustrates the firearm 40 mounted to the rack 15, in accordance with one embodiment of the present disclosure.

It should be understood that FIG. 1 is shown to illustrate the firearm 40 in alignment with the magnetic section 25 of the rack 15. In order to mount the firearm 40 to the magnetic section 25 of the rack 15, the magnetic strip 50 on the firearm 40 is brought closer to the magnetic section 25. Subsequently, the firearm 40 is mounted to the rack 15 at the magnetic section 25, as shown in FIG. 4. When the magnetic strip 50 on the firearm 40 is mounted to the magnetic section 25, the first processor 31 recognizes that the firearm 40 is connected to the magnetic section 25. Further, when the firearm 40 is detached from the magnetic section 25, the first processor 31 recognizes that the firearm 40 is no longer connected to the magnetic section 25. After mounting the firearm 40 to the magnetic section 25 of the rack 15, the door 20 might be closed. It should be understood that the door 20 might be configured with an authentication mechanism comprising a predetermined passcode or lock pattern or key to operate the door 20.

Figure 5:
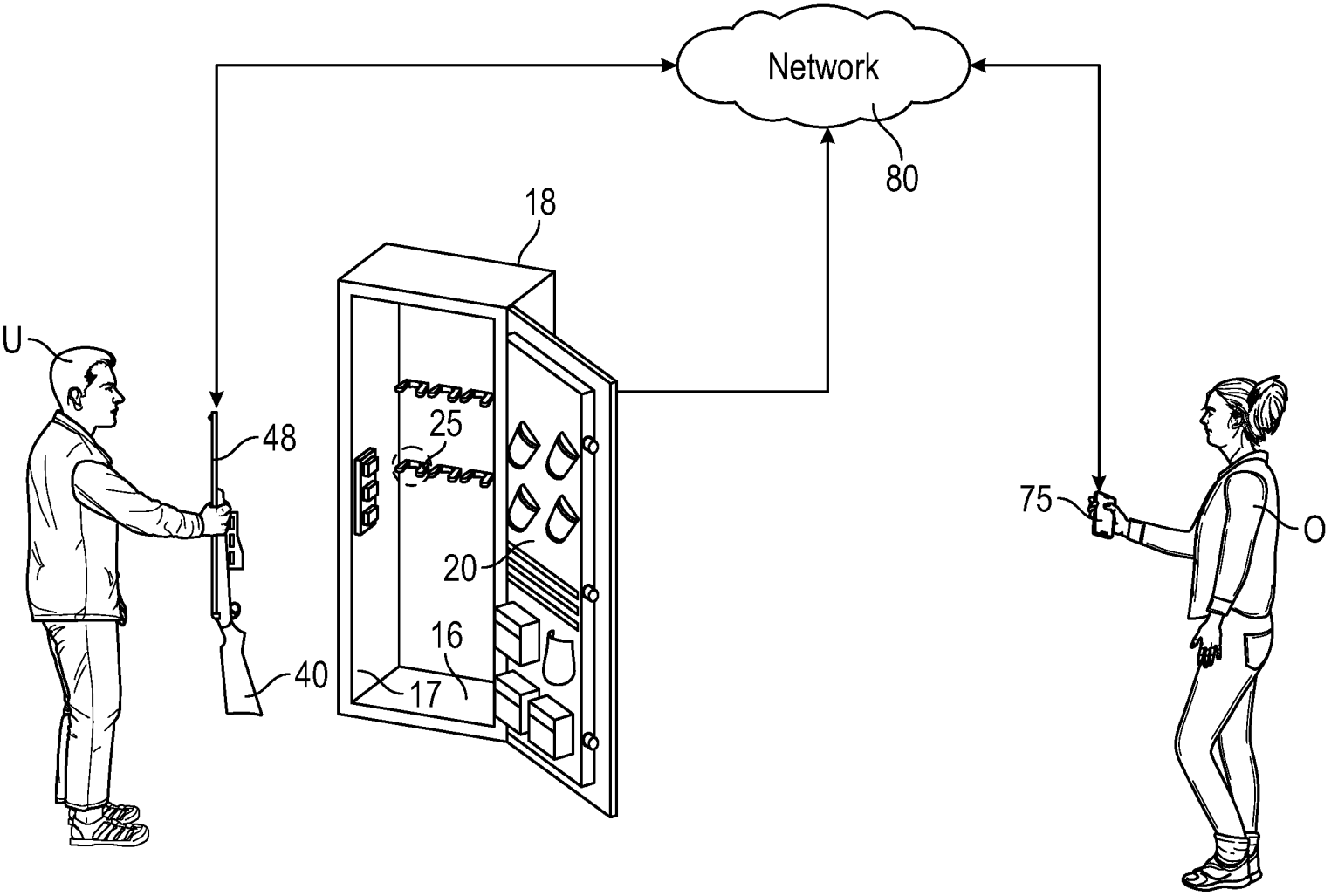
FIG. 5 illustrates a scenario in which an unauthorized user U accesses the firearm 40 and sending a notification to an owner O of the firearm 40 to allow him to track the firearm 40, in accordance with one embodiment of the present disclosure.
Figure 6:
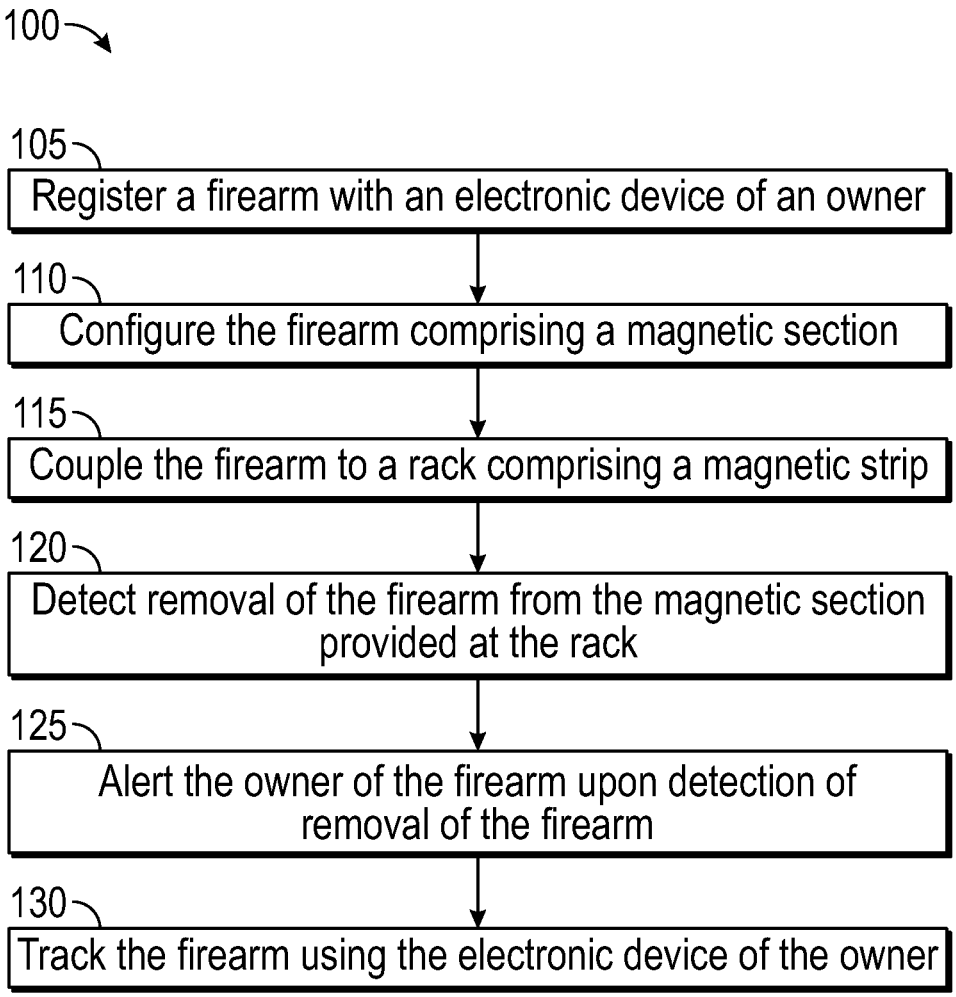
FIG. 6 illustrates a method 100 of securing a firearm and alerting an owner of the firearm when an unauthorized user accesses the firearm, in accordance with one embodiment of the present disclosure.

Referring to FIG. 5, operation of the firearm security system 10 to alert an owner O of the firearm 40 when the firearm 40 is accessed or used by an unauthorized user U is explained. As specified above, the rack 15 might be provided with an authentication mechanism e.g., security passcode. In one example, the authentication mechanism might include six digits numeric or alphanumeric or combination thereof. The authentication mechanism might be configured using the display 22 provided at the door 20. In another example, the authentication mechanism may include a biometric system such as iris scan, numeric passcode, face recognition, fingerprint recognition and so on and so on. It should be understood that the mechanism is used for identifying the owner O. It should be understood that the authentication mechanism might be provided such that the owner O may enter a predetermined authentication code or biometric identification of the owner O to operate the rack 15, to open the door 20 and access the firearm 40 from the magnetic section 25.

In one implementation, the firearm 40 is provided with a unique identification number. The unique identification number might be stored in the microcontroller 52 provided in the magnetic strip 50 on the firearm 40. Subsequently, the unique identification number is registered with the first processor 31. Further, the unique identification number is registered with an electronic device 75 of the owner of the firearm 40. The electronic device 75 may include a mobile phone, a tablet, a wristwatch, a desktop and so on. The electronic device 75 may store the unique identification number of the firearm 40 along with style and caliber of the firearm 40.

When the firearm 40 is mounted to the magnetic section 25, the first processor 31 may transmit a signal to the electronic device 75 via the first transceiver 32 indicating that the firearm 40 is mounted to the magnetic section 25 of the rack 15. As can be seen in FIG. 5, the first transceiver 32 may transmit the signal via a network 80. The network 80 may include a wireless network, a wired network or a combination thereof. It should be understood that the network 80 might indicate a long-range or short-range communication protocol, which includes satellite communication, cellular network Bluetooth, WI-FI, Li-Fi, infrared and so on to facilitate communication between the rack 15 and the electronic device 75. The network 80 can be implemented as one of the different types of networks, such as intranet, local area network (LAN), wide area network (WAN), the internet, and the like.

The first transceiver 32 may transmit the signal either in real time or in a predetermined time interval such as 30 seconds or 10 minutes or one hour etc. As explained above, the owner O may have to enter the predetermined code to open the door 20 and remove the firearm 40 from the magnetic section 25. If the firearm 40 is removed from the magnetic section 25 without the first processor 31 receiving the predetermined code, then pressure sensor 27 detects that the firearm 40 is removed from the magnetic section 25. Subsequently, the pressure sensor 27 sends a signal to the first processor 31 indicating that an authorized user U has removed the firearm 40 from the magnetic section 25. Subsequently, the first processor 31 may instruct the first transceiver 32 to transmit the signal to the electronic device 75 to notify the owner O that the unauthorized user U has removed the firearm 40 from the magnetic section 25 without authorization.

Alternatively, the first processor 31 might be configured to wait for a predefined time e.g., 30 seconds for entering the predetermined code after removing the firearm 40 from the r magnetic section 25. If the first processor 31 does not receive the predetermined code within the predefined time, then the first processor 31 may instruct the first transceiver 32 to notify the owner O that the unauthorized user U has removed the firearm 40 from the magnetic section 25. The notification sent to the electronic device 75 may include a message, an alarm, a telephone call and so on.

Concurrently and consecutively, the second transceiver 54 provided in the firearm 40 might be activated. When activated, the second transceiver 54 may transmit the location of the firearm 40 to the electronic device 75 via the network 80.

It should be understood that the second transceiver 54 might be configured to the transmit the location of the firearm 40 either in real time or in a predetermined time interval such as 30 seconds or 10 minutes or one hour etc. Preferably, the second transceiver 54 is configured to transmit the location of the firearm 40 in real time.

Although it is explained that the notification of removal of the firearm 40 by the unauthorized user U is sent to the electronic device 75 of the owner O, it should be understood that the notification may also be sent to emergency personnel such as police. After receiving the notification, the owner O or police can track the location of the firearm 40 with the help of the second transceiver 54. The owner O and/or the police can track location of the firearm 40 and prevent or limit use of the firearm 40 by the authorized user U.

It should be understood that the firearm security system could be used to mount multiple firearms to the rack and track each of the firearms if the unauthorized user accesses them. As each of the firearms are provided with a unique identification number, the processor in the rack can notify the owner which firearm is removed from the rack. Accordingly, the owner and/or the police will be notified to take necessary action to prevent the authorized user from using the firearm to commit a crime.

In one alternate embodiment, the rack 15 might be provided with an audio output such as a speaker at outer surface of the rack 15. The audio output might be communicatively mounted to the first processor 31. When the pressure sensor 27 detects that the firearm 40 is removed from the magnetic section 25, the pressure sensor 27 may send a signal to the first processor 31 indicating that an authorized user U has removed the firearm 40 from the magnetic section 25. Subsequently, the first processor 31 may instruct the audio output to produce sound or noise indicating that the unauthorized user U has removed the firearm 40 from the magnetic section 25 without authorization. Based on the sound produced, people in the vicinity of the rack 15 might be alerted to indicate that the unauthorized user U has removed the firearm 40 from the rack 15.

It should be understood that the first processor 31 might instruct the first transceiver 32 to transmit an alert to the electronic device 75 of the owner O and instruct the audio output to produce sound simultaneously when the pressure sensor 27 sends the signal to the first processor 31 indicating that an authorized user U has removed the firearm 40 from the magnetic section 25. Alternatively, the first transceiver 32 might instruct the audio output to produce sound when the first transceiver 32 cannot send the notification to the electronic device 75 of the owner O.

In order to deactivate the sound produced by the audio output, the user may send instructions from the electronic device 75. Alternatively, the owner O or any other occupant of the house might use the display 22 to deactivate the audio output from producing the sound.

In one alternate embodiment, the location of the firearm 40 might be displayed on the display 22 such that the owner O or the occupant of the house might see and track the location of the firearm 40. By displaying the location of the firearm 40, the display 22 helps to track the location of the firearm 40 in case the electronic device 75 is not is use or working.

Referring now to FIG. 4, a method 100 for securing the firearm and alerting and tracking the firearm when an unauthorized user removes the firearm is shown, in accordance with an embodiment of the present disclosure. The method 100 may be described in the general context of computer executable instructions or a sequence of steps to be performed for automated checkout. However, the order in which the method 100 is described and is not intended to be construed as a limitation, and any number of the described method blocks can be combined in any order to implement the method 100 or alternate methods. Additionally, individual blocks may be deleted from the method 100 without departing from scope of the disclosure described herein. For ease of explanation, in the embodiments described below, the method 100 may be implemented in the above-described firearm security system 10.

At step 105, a firearm 40 is registered with an electronic device 75 of an owner. Specifically, the firearm 40 is registered by providing a unique identification number, make, style and caliber of the firearm 40.

At step 110, the firearm 40 is configured with the unique identification number. As specified above, the firearm 40 is provided with a magnetic strip 50.

At step 115, the firearm 40 is coupled or mounted to a rack 15 comprising a magnetic section 25.

At step 120, the rack 15 detects removal of the firearm 40 from the magnetic section 25 provided at the rack 15.

At step 125, upon detecting the removal of the firearm 40 from the magnetic section 25, the first processor 31 alerts the owner O of the firearm 40. Specifically, the first processor 31 is configured to alert the owner O by sending a notification via message/SMS, call, and alarm on the electronic device 75 of the owner O.

At step 130, a second transceiver 54 in a magnetic strip 50 of the firearm 40 is activated such that the owner O of the electronic device 75 can track location of the firearm 40.

Based on the above, it should be understood that the present disclosure discloses a simple mechanism with which the magnetic strip is mounted to the firearm. As such, the magnetic strip and the second transceiver i.e., location sensor can be mounted to a new firearm or existing firearm. In other words, as the magnetic strip is mounted to the firearm externally, the magnetic strip that allows tracking the firearm can be retrofitted to an existing firearm or might be provided with a new firearm.

Further, when the unauthorized user removes the firearm from the rack, a notification is sent to the owner of the firearm and also to the police. As a result, immediate action can be taken either by the owner or the police to prevent the authorized user from using the firearm to commit a crime.

Although it is shown that the magnetic strip is mounted at the barrel of the firearm, the magnetic strip can be mounted to any other part of the firearm. As such, when the magnetic strip is separated from the magnetic section, an alert is sent to the owner indicating that an unauthorized user removed the firearm.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm security system for securing a firearm and alerting an owner of the firearm when an unauthorized user accesses the firearm, the firearm security system comprising:

a rack comprising a door, wherein the door is operated using an authentication mechanism, wherein said rack includes a bottom, sidewalls, a top, and a rear wall forming a rectangular shape, wherein the rack comprises magnetic sections mounted to an inner area of said rear wall, wherein said magnetic sections include a U-shaped structure with a pressure sensor located within an inner side of said magnetic sections, and wherein the rack comprises a first processor, a first transceiver, and a first battery; and a magnetic strip provided at a barrel of said firearm, wherein the magnetic strip of the firearm is mounted to the magnetic sections, wherein said barrel is received by an inner area of said magnetic sections to make contact with said pressure sensor, wherein said firearm is mounted in a vertical configuration within said rack and is received by two of said magnetic sections, said magnetic strip including a second processor, a second transceiver, and a second battery, wherein the first said second processor transmits an alert to an electronic device of the owner when the firearm is removed from the magnetic sections without an authentication mechanism, indicating that an unauthorized user removed the firearm from the rack.

2. The firearm security system of claim 1, wherein rack includes a box-like structure.

3. The firearm security system of claim 1, wherein the second transceiver transmits location of the firearm to the electronic device and facilitates in tracking the firearm.

4. The firearm security of claim 1 further includes a display in the form of a touch screen mounted to a front end of the door adapted to control and operate the firearm security system locally.

5. The firearm security system of claim 1, wherein said magnetic sections are mounted perpendicular to said rear wall.

6. The firearm security system of claim 1, wherein said magnetic sections are provided in two sets of rows each having three of said magnetic sections.

7. The firearm security system of claim 1, wherein said first processor, said first transceiver, and said first battery are located within a housing provided within said rack.

8. A firearm security system for securing a firearm and alerting an owner of the firearm when an unauthorized user accesses the firearm, comprising:

a) a firearm including a stock, a trigger, a trigger guard surrounding said trigger, and a barrel;

b) a rack including a bottom, sidewalls, a top, and a rear wall forming a rectangular shape, wherein said rack further includes a door located at a front end, wherein said door includes a display in the form of a touch screen input device, said rack including a plurality of magnetic sections mounted onto an inner side of said rear wall, said plurality of magnetic sections provided in two sets of rows each having three magnetic sections, wherein said plurality of magnetic sections have a "U" shaped structure and includes a pressure sensor, wherein said pressure sensor is located within an inner side of said "U" shaped structure, said plurality of magnetic sections mounted in a perpendicular configuration relative to said inner side of said rear wall, said rack further including a housing located at a sidewall of said sidewalls, said housing including a first processor, a first transceiver, and a first battery; and c) a magnetic strip mounted onto said barrel of said firearm, wherein said magnetic strip including a second processor, a second transceiver, and a second battery, wherein said magnetic strip is received by an inner portion of said plurality of magnetic sections, wherein in said firearm is placed vertically within said rack, wherein said firearm is received by two of said plurality of magnetic sections, wherein said first processor transmits an alert to an electronic device of an owner when said firearm is removed from said plurality of magnetic sections without an authentication mechanism, indicating that an unauthorized user removed the firearm from said rack, wherein said second transceiver determines a location of said firearm, and wherein said second transceiver transmits said location of the firearm to said electronic device and said rack.

* * * * *